US008465348B2

(12) United States Patent
Boeck et al.

(10) Patent No.: US 8,465,348 B2
(45) Date of Patent: Jun. 18, 2013

(54) GUARD ANTI-ROTATION LOCK

(75) Inventors: Cornelius Boeck, Kirchheim (DE); Joachim Schadow, Leinfeldin-Echterdingen (DE); Sinisa Andrasic, Schoenaich (DE)

(73) Assignee: Robert Bosch GmbH, Stuttgart (DE)

( * ) Notice: Subject to any disclaimer, the term of this patent is extended or adjusted under 35 U.S.C. 154(b) by 442 days.

(21) Appl. No.: 12/280,009

(22) PCT Filed: Nov. 9, 2007

(86) PCT No.: PCT/EP2007/062104

§ 371 (c)(1),
(2), (4) Date: Aug. 20, 2008

(87) PCT Pub. No.: WO2008/058900

PCT Pub. Date: May 22, 2008

(65) Prior Publication Data

US 2009/0019899 A1 Jan. 22, 2009

(30) Foreign Application Priority Data

Nov. 13, 2006 (DE) ..... 10 2006 053 305

(51) Int. Cl.
*B24B 55/04* (2006.01)

(52) U.S. Cl.
USPC ..... 451/451; 451/359; 451/452

(58) Field of Classification Search
USPC ..... 451/344, 359, 451, 452
See application file for complete search history.

(56) References Cited

U.S. PATENT DOCUMENTS

| | | | | | |
|---|---|---|---|---|---|
| 4,060,940 | A * | 12/1977 | DeWitt | 451/358 |
| 4,574,532 | A * | 3/1986 | Haberle et al. | 451/451 |
| 4,791,541 | A * | 12/1988 | Simmons | 362/376 |
| 4,924,635 | A * | 5/1990 | Rudolf et al. | 451/344 |
| 5,005,321 | A * | 4/1991 | Barth et al. | 451/359 |
| 5,384,985 | A * | 1/1995 | Jacobsson | 451/344 |
| 5,440,815 | A * | 8/1995 | Inkster | 30/390 |
| 5,766,062 | A * | 6/1998 | Edling | 451/451 |
| 6,464,573 | B1 * | 10/2002 | Keller | 451/451 |
| 6,669,544 | B1 * | 12/2003 | Walz et al. | 451/454 |
| 6,699,114 | B1 * | 3/2004 | Campbell et al. | 451/451 |
| 6,893,334 | B1 * | 5/2005 | Stivers | 451/359 |
| 6,949,017 | B2 * | 9/2005 | Koschel et al. | 451/358 |
| 6,988,939 | B2 * | 1/2006 | Hofmann et al. | 451/344 |
| 7,063,606 | B2 * | 6/2006 | Stierle et al. | 451/359 |
| 7,311,589 | B2 * | 12/2007 | Wiker | 451/451 |
| 2004/0014412 | A1 * | 1/2004 | Hofmann et al. | 451/451 |
| 2006/0052041 | A1 * | 3/2006 | Wiker | 451/451 |

FOREIGN PATENT DOCUMENTS

| | | |
|---|---|---|
| DE | 36 36 601 | 5/1988 |
| DE | 37 42 430 | 6/1989 |
| DE | 90 10 138 | 9/1990 |
| DE | 44 22 247 | 1/1996 |

(Continued)

*Primary Examiner* — Eileen P. Morgan
(74) *Attorney, Agent, or Firm* — Michael J. Striker

(57) ABSTRACT

The invention relates to a protective hood anti-rotation lock for a portable power tool (12*a-e*), especially an angle grinder. Said protective hood anti-rotation lock is characterized in that it comprises an anti-rotation unit (14*a-e*) that is adapted to take into consideration at least one operating parameter of the portable power tool (12*a-e*) during anti-rotational locking.

11 Claims, 6 Drawing Sheets

FOREIGN PATENT DOCUMENTS

| | | |
|---|---|---|
| DE | 296 01 002 | 5/1997 |
| DE | 101 15 635 | 10/2002 |
| EP | 0 812 657 | 12/1997 |
| EP | 0 978 353 | 2/2000 |
| EP | 1 522 390 | 4/2005 |
| EP | 1 618 990 | 1/2006 |
| RU | 2 152 862 | 7/2000 |
| SU | 301270 | 4/1971 |
| SU | 495 192 | 12/1975 |
| WO | 2004/087377 | 10/2004 |

* cited by examiner

GUARD ANTI-ROTATION LOCK

CROSS-REFERENCE TO A RELATED APPLICATION

The invention described and claimed hereinbelow is also described in German Patent Application DE 10 2006 053 305.4 filed on Nov. 13, 2006. This German Patent Application, whose subject matter is incorporated here by reference, provide the basis for a claim of priority of invention under 35 U.S.C. 119(*a*)-(*d*).

BACKGROUND OF THE INVENTION

The present invention relates to a guard anti-rotation lock.

Publication EP 812 657 A1 makes known an angle grinder with an adjustable guard. In that case, the guard is adjustable in a rotating manner on a connection piece of a flange of the angle grinder, and is supported such that it may be detachably attached using a single form-fit locking means. The spindle of the angle grinder passes through the center of the flange. A cutting and/or grinding disk is installed on the free end of the spindle in a clampable, rotationally drivable manner for cutting and machining work pieces, which are partially enclosed by the guard. The guard must be positioned in a rotationally adjustable manner on the hand-held power tool such that the region of the grinding disk that faces the user is enclosed by the guard. At the same time, a region of the grinding disk that points away from the user extends past the flange, radially relative to the work piece engagement.

SUMMARY OF THE INVENTION

The present invention relates to a guard anti-rotation lock for a hand-held power tool, in particular for an angle grinder.

It is provided that the guard anti-rotation lock includes a rotation lock unit, which is provided to take into account at least one operating parameter of the hand-held power tool when preventing rotation. The anti-rotation lock unit of the guard anti-rotation lock is preferably provided to prevent rotation between a guard and/or a guard together with a clamping band and the hand-held power tool, in particular a hand-held power tool receiving unit of the hand-held power tool. Due to the inventive design of the guard anti-rotation lock, it is possible to effectively protect an operator of the hand-held power tool from a—disk-shaped in particular—tool, which rotates during operation of the hand-held power tool, and/or, in particular, from parts of the tool that are slung in the direction of the operator if the tool becomes damaged, e.g., if the tool should burst. The operating parameter preferably includes an active state of the hand-held power tool, so that the anti-rotation lock unit is provided to account for an active state of the hand-held power tool, thereby making it advantageously possible to protect an operator during operation of the hand-held power tool. The active state of the hand-held power tool is advantageously a torque of a tool and/or a drive torque of a drive shaft for driving the tool, and/or a switched-on state of a motor unit of the hand-held power tool.

It is also provided that the anti-rotation lock unit is provided to prevent rotation between a guard unit and the hand-held power tool during a breakdown of the tool. In this context, "provided" is intended to mean, in particular, specially equipped and/or designed. In addition, a "breakdown of the tool" is intended to mean, in particular, a tool that bursts during operation of the hand-held power tool, in which case individual tool parts may be slung outwardly due to rotation of the tool, and the outwardly slung tool parts are preferably captured by the guard unit. Advantageously, a sizing of the anti-rotation lock unit is designed to absorb forces that occur when the tool becomes damaged, these forces being transferred from tool parts that strike the guard unit to the guard unit itself. A position of the guard unit is preferably maintained when the tool becomes damaged via the anti-rotation lock unit and proper functioning of the guard unit. The inventive design provides reliable protection of the operator during operation of the hand-held power tool by ensuring that an advantageous protective position of the guard unit may be retained on the hand-held power tool in a non-rotatable manner during the breakdown.

A particularly effective anti-rotation lock during operation of the hand-held power tool between the guard unit and the hand-held power tool may be attained when the guard anti-rotation lock includes a form-fit unit, which is provided to establish a form-fit connection between the guard unit and the hand-held power tool.

Furthermore, a hand-held power tool, in particular an angle grinder, with a guard anti-rotation lock is provided, the anti-rotation lock unit including at least one anti-rotation lock element that is located on a hand-held power tool housing and/or a hand-held power tool receiving unit, by way of which a rotation lock with a simple design may be realized. The term "located" is intended to mean, in particular, that the anti-rotation lock element is fastened to and/or movably supported on the hand-held power tool housing and/or the hand-held power tool receiving unit. The anti-rotation lock element may be proved to establish a non-positive and/or—particularly advantageously—a form-fit anti-rotation lock between the guard unit and the hand-held power tool, in particular in that the anti-rotation lock element is designed as a form-fit element, e.g., a bolt and/or a toothing and/or further form-fit elements that appear reasonable to one skilled in the technical art.

A particularly easy means for attaching and removing the guard unit to/from the hand-held power tool may be advantageously attained when the anti-rotation lock element is movably located on the hand-held power tool housing and/or the hand-held power tool receiving unit. The anti-rotation lock element is preferably moved into an anti-rotation lock position at the start of operation, and it is moved out of the anti-rotation lock position and into an inactive position after operation of the hand-held power tool and/or the tool, in particular when the hand-held power tool is in an active state. In the inactive position, an anti-rotation lock between the guard unit and the hand-held power tool is advantageously released.

In an alternative embodiment of the present invention, it is provided that the anti-rotation lock unit includes at least one rotatably supported lever element on which the anti-rotation lock element is at least partially located, by way of which the anti-rotation lock element may be advantageously moved into an anti-rotation lock position and/or into an inactive position using the lever element.

It is also provided that the anti-rotation lock unit includes a fan, which is provided to generate an air flow for moving the lever element into an anti-rotation lock position, thereby making it advantageously possible to couple the anti-rotation lock to an operation—in particular an active state—of the hand-held power tool and/or the tool. The fan is preferably driven during operation by a shaft that is provided to transfer drive torque to the tool.

When the lever element also includes—at least partially—a chamber-like recess on a side that faces the fan, it is possible to reinforce an effect of the force of the air flow on the lever element using a simple design, in order to move the lever element and/or the anti-rotation lock element that is located on the lever element.

It is also provided that the anti-rotation lock unit includes a shaft with an eccentric element, which is provided to move the anti-rotation lock element into an anti-rotation lock position, thereby making it advantageously possible to couple the anti-rotation lock to an operation and/or an active state of the hand-held power tool. The shaft may be designed as a single piece with a drive shaft for driving the tool, or, particularly advantageously, it may be a shaft that is separate from the drive shaft and that is preferably coupled to a transfer of torque from the drive shaft and/or that is non-rotatably located on the drive shaft. An "eccentric element" is intended to mean, in particular, an element that is preferably located on the shaft in an eccentric manner and that presses the anti-rotation lock element into an anti-rotation lock position when the shaft rotates. Particularly advantageously, the eccentric element is designed as a leaf spring, thereby making it possible to reduce wear on the anti-rotation lock element and/or the eccentric element, in particular due to friction between the anti-rotation lock element and the eccentric element.

When the anti-rotation lock unit includes at least one restoring element that is designed to move the anti-rotation lock element into an inactive position, it is advantageously possible to release an anti-rotation lock between the guard unit and the hand-held power tool in a switched-off operating mode, and/or in an inactive state of the hand-held power tool, so that the guard unit may be removed by an operator of the hand-held power tool. In this context, an "inactive position" is intended to mean, in particular, a position of the anti-rotation lock element in which an anti-rotation lock between the guard unit and the hand-held power tool is advantageously released. The restoring element is designed as a magnet and/or, particularly advantageously, by a spring element, and/or by other restoring elements that appear reasonable to one skilled in the technical art.

In an advantageous refinement of the present invention, a guard unit with a guard anti-rotation lock is provided, the anti-rotation lock unit including at least one anti-rotation lock element that is located on a guard and/or a clamping band, by way of which a rotation lock between the guard unit and the hand-held power tool may be realized using a simple design. The guard unit preferably includes a guard and a closing unit with a clamping band.

It is also provided that the anti-rotation lock element is designed as a form-fit element that is provided to establish a form-fit connection with the hand-held power tool, thereby making it possible to attain a particularly effective anti-rotation lock between the guard unit and the hand-held power tool, even in the presence of strong forces—tangential forces, in particular—that act on the guard unit. This may be attained in a particularly advantageous manner when the form-fit element is designed as a recess. Any other form-fit elements that appear reasonable to one skilled in the technical art are also feasible in an alternative embodiment, of course.

When the anti-rotation lock unit includes at least two anti-rotation lock elements that are located one after the other in the circumferential direction, a reusable form-fit and/or non-positive connection between the guard unit and the hand-held power tool may be attained, and/or the guard unit may be advantageously and non-rotatably installed in different positions along the circumferential direction on the hand-held power tool. The term "circumferential direction" is intended to mean, in particular, a circumferential direction of the guard unit, which is oriented essentially parallel to a direction of rotation of the tool when the guard unit is in an installed state.

In an advantageous refinement of the present invention, a hand-held power tool system is provided with a hand-held power tool, in particular an angle grinder that includes a hand-held power tool receiving unit for receiving a disk-shaped tool, and with a guard unit and a guard anti-rotation lock that includes an anti-rotation lock unit that is provided to couple—at least partially—an anti-rotation lock between the guard unit and the hand-held power tool to an operating parameter of the hand-held power tool. It is possible to effectively protect an operator of the hand-held power tool from a—disk-shaped in particular—tool, which rotates during operation of the hand-held power tool, and/or, in particular, from parts of the tool that are slung in the direction of the operator if the tool becomes damaged, e.g., if the tool should burst. The operating parameter preferably includes an active state of the hand-held power tool, so that the anti-rotation lock unit is provided to account for an active state of the hand-held power tool, thereby making it advantageously possible to protect an operator during operation of the hand-held power tool. The active state of the hand-held power tool is advantageously a torque of a tool and/or a drive torque of a drive shaft for driving the tool, and/or a switched-on state of a motor unit of the hand-held power tool.

It is also provided that the anti-rotation lock unit includes at least one anti-rotation lock element that is located on a hand-held power tool housing and/or a hand-held power tool receiving unit, by way of which a particularly easy means for attaching and removing the guard unit may be advantageously attained. The anti-rotation lock element may be provided to establish a non-positive anti-rotation lock, and particulary advantageously, a form-fit anti-rotation lock between the guard unit and the hand-held power tool.

A particularly advantageous anti-rotation lock of the guard unit on the hand-held power tool that is coupled to a transfer of a drive torque from a motor unit of the hand-held power tool to a tool and/or an operation, in particular an active state of the hand-held power tool, may be attained when the hand-held power tool includes an actuating element for adjusting a spindle lock function and/or an actuating element for switching a motor unit of the hand-held power tool on and off, the actuating element being coupled with the anti-rotation lock element. The term "spindle lock function" refers, in particular, to an operating function of a drive shaft in which a rotational motion of the drive shaft is blocked and a transfer of a drive torque from the drive shaft to the tool is thereby prevented. The term "coupled" is intended to mean, in particular, an electrical, electronic, and/or—particularly advantageously—a mechanical coupling between the anti-rotation lock element and the actuating element.

It is also provided that the hand-held power tool includes a fan, which is provided to generate an air flow for moving the anti-rotation lock element into an anti-rotation lock position, thereby making it advantageously possible to couple the anti-rotation lock to an operation and/or an active state of the hand-held power tool and/or the tool. The fan is preferably driven during operation by a shaft that is provided to transfer drive torque to the tool.

Particularly advantageously, the hand-held power tool includes at least one ventilation opening for air to exit, the anti-rotation lock element being located downstream of the ventilation opening in a direction of flow of the air, thereby making it possible for the anti-rotation lock element to be moved into an anti-rotation lock position using the air flow.

In an advantageous refinement of the present invention, it is provided that the guard anti-rotation lock includes at least one anti-rotation lock element, which is located on the guard unit. As a result, it is possible to realize an anti-rotation lock with a simple design, in particular when the anti-rotation lock element interacts with an anti-rotation lock element of the hand-held power tool in a form-fit and/or non-positive manner. Particularly advantageously, the anti-rotation lock element is located, at least partially, on a clamping band, and/or on a guard collar of a guard of the guard unit.

Particularly advantageously, the present invention includes a hand-held power tool for a rotating, preferably disk-shaped tool, with a hand-held power tool housing that includes a flange and/or a machine neck, on which a guard—that is composed of sheet metal in particular—is detachably clampable in order to cover the tool. The guard includes a guard body, which is composed of a circular disk-shaped piece, in particular with an outer edge located at a right angle thereto, and with a central, circular recess, on the edge of which a guard connection piece and/or collar is formed and that includes an annular clamping band that may be tightened using a clamping means. An anti-rotation lock that acts between the machine neck and the guard is located between the guard and the machine neck and is designed as a profiled structure. The guard may be repeatedly coupled via the clamping band and/or the clamping means in its clamping position in a form-fit and/or non-positive manner with the machine neck, and is therefore capable of being fixed in a non-rotatable position and, to attain a release position, may be disengaged from the form-fit and/or non-positive connection, so that the guard may then be adjusted in a rotational manner.

Further advantages result from the description of the drawing, below. Exemplary embodiments of the present invention are shown in the drawing. The drawing, the description, and the claims contain numerous features in combination. One skilled in the art will also advantageously consider the features individually and combine them to form further reasonable combinations.

DESCRIPTION OF THE PREFERRED EMBODIMENTS

Figure 1:
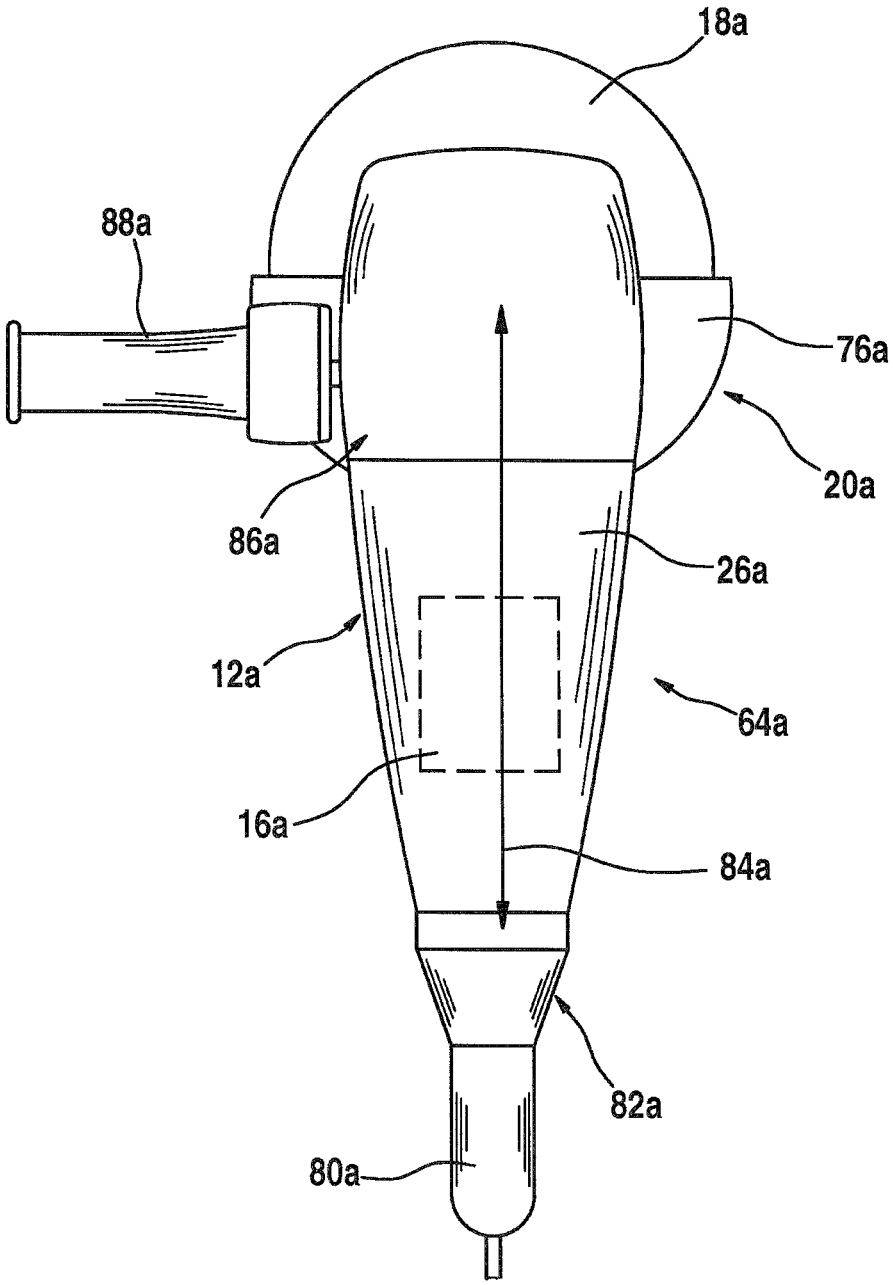
FIG. 1 shows an inventive hand-held power tool system in a schematic depiction.

FIG. 1 shows a hand-held power tool system 64*a* with a hand-held power tool 12*a* designed as an angle grinder, and with a guard unit 20*a*, in a view from above. The angle grinder includes a hand-held power tool housing 26*a*, a motor unit 16*a*, and a main handle 80*a* integrated in hand-held power tool housing 26*a*. Main handle 80*a* extends on a side 82*a* facing away from a tool 18*a* that is a cutting disk, in a longitudinal direction 84*a* of the angle grinder. An auxiliary handle 88*a* is located in a front region 86*a* of the angle grinder that is close to the tool, and extends transversely to longitudinal direction 84*a* of the angle grinder.

Figure 2:
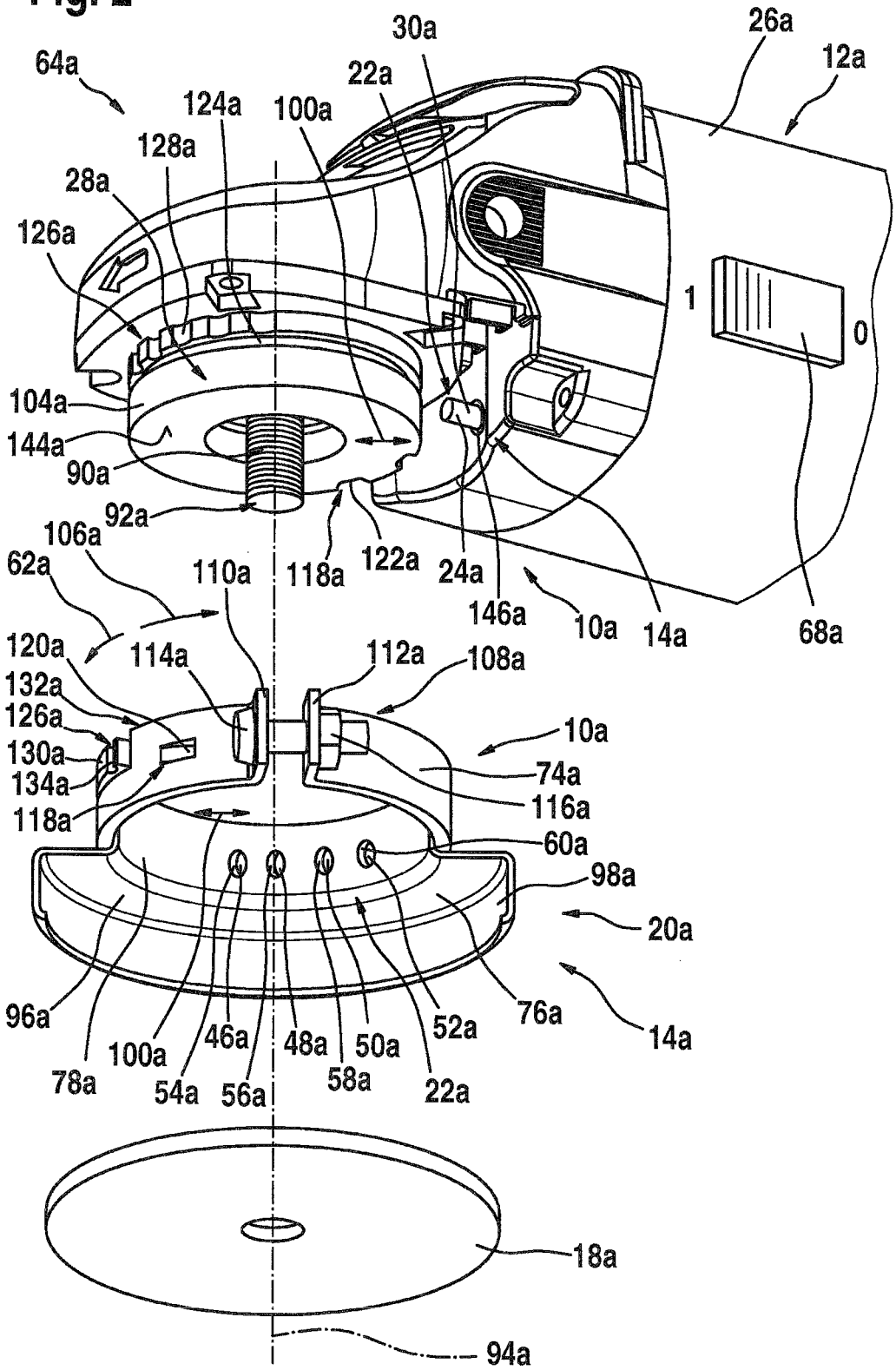
FIG. 2 shows an exploded view of sections of a hand-held power tool system with a hand-held power tool, a guard unit, and a guard anti-rotation lock.

FIG. 2 shows hand-held power tool system 64*a* with hand-held power tool 12*a*, guard unit 20*a*, and a guard anti-rotation lock 10*a*, in sections. Guard anti-rotation lock 10*a* includes an anti-rotation lock unit 14*a*, which is provided to account for at least one operating parameter of hand-held power tool 12*a* when preventing rotation. To accommodate guard unit 20*a* and/or tool 18*a*, hand-held power tool 12*a* includes a hand-held power tool receiving unit 28*a*, which is screwed together with hand-held power tool housing 26*a* of hand-held power tool 12*a*. A drive shaft 90*a* extends out of hand-held power tool receiving unit 28*a* on a side 144*a* facing away from hand-held power tool housing 26*a*. Drive shaft 90*a* is connectable at its free end 92*a* with disk-shaped tool 18*a* and is rotationally drivable around an axis 94*a*. Axis 94*a* of drive shaft 90*a* is oriented perpendicularly to longitudinal direction 84*a* of hand-held power tool 12*a*. Guard unit 20*a* includes a guard 76*a* and a clamping band 74*a*. Guard 76*a* extends around an angular range of tool 18*a* of approximately 180° and, to this end, includes a semi-disk shaped guard body 96*a* and a guard edge 98*a*, which is initially oriented perpendicularly to semi-disk shaped body 96*a* and is finally oriented parallel to semi-disk shaped guard body 96*a*, inwardly in a radial direction 100*a*.

Guard unit 20*a* also includes a guard collar 78*a*, which is oriented essentially perpendicularly to semi-disk shaped guard body 96*a*. Guard collar 78*a* is enclosed outwardly in radial direction 100*a* by clamping band 74*a*. Guard collar 78*a* and clamping band 74*a* are interconnected via a welded connection. Guard collar 78*a*—together with clamping band 74*a*—is provided to attach guard unit 20*a* to hand-held power tool 12*a* and/or to hand-held power tool receiving unit 28*a*, which includes a cylindrical receiving flange 104*a* for this purpose. Along a circumferential direction 62*a*, 106*a* of clamping band 74*a*, clamping band 74*a* includes two end regions 110*a*, 112*a* in a region 108*a* that faces away from guard 76*a* and extends outwardly in radial direction 100*a*. End regions 110*a*, 112*a* each include a recess through which a clamping element 114*a* designed as a clamping screw extends. The clamping screw may be fastened in the recesses of clamping band 74*a* using a nut 116*a*. A diameter of clamping band 74*a* may be varied using the clamping screw, thereby allowing guard unit 20*a* to be attached in a non-positive manner to receiving flange 104*a* of hand-held power tool 12*a* using a frictional connection.

Anti-rotation lock unit 14*a* secures guard unit 20*a* against accidental rotation during operation and/or when hand-held power tool 12*a* is in an active state, e.g., in particular, if tool 18*a* should become damaged, e.g., if tool 18*a* should burst, thereby providing advantageous protection for an operator of hand-held power tool 12*a*. Anti-rotation lock 14*a* is sized such that the strong forces of outwardly slung tool parts that produced when the tool becomes damaged are absorbed. To this end, guard anti-rotation lock 10*a* includes a form-fit unit 22*a*, which is provided to establish a form-fit connection between guard unit 20*a* and receiving flange 104*a* of hand-held power tool 12*a*. To establish the form-fit connection, form-fit unit 22*a* and/or anti-rotation lock 14*a* include(s) an anti-rotation lock element 24*a* that is designed as a form-fit element 30*a* and is located on hand-held power tool housing 26*a* of hand-held power tool 12*a*. Form-fit element 30*a* is designed as a cylindrical bolt that is movably supported in hand-held power tool housing 26*a*, which includes a recess 146*a* for this purpose. As viewed from axis 94*a*, the bolt is supported in hand-held power tool housing 26*a* such that it is movable perpendicularly to axis 94*a* along radial direction 100*a*.

Anti-rotation lock unit 14*a* and/or form-fit unit 22*a* include further anti-rotation lock elements 46*a*, 48*a*, 50*a*, 52*a*, each of which is designed as a form-fit element 54*a*, 56*a*, 58*a*, 60*a*, and which are located on guard unit 20*a*. Anti-rotation lock elements 46*a*, 48*a*, 50*a*, 52*a* are located one after the other in circumferential direction 62*a*, 106*a* on clamping band 74*a* and guard collar 78*a* of guard unit 20*a*, and are designed as circular recesses. During operation and/or in the active state of hand-held power tool 12*a*, the bolt extends through one of the recesses, thereby securing guard unit 20*a* against rotation on hand-held power tool 12*a*. To this end, the bolt is coupled to a switching mechanism—only a portion of which is shown—of hand-held power tool 12*a* and, therefore anti-rotation lock unit 14*a* is coupled to an operating parameter of hand-held power tool 12*a*. The switching mechanism includes an actuating element 68*a* of hand-held power tool 12*a* that is coupled to motor unit 16*a*, so that an operator may switch motor unit 16*a* on or off using actuating element 68*a*. The operating parameter of hand-held power tool 12*a* is represented by a switched-on position of actuating element 68*a*. Via the coupling of the bolt to the switching mechanism, the bolt is located—when hand-held power tool 12*a* is in a switched-off state—in a recessed and/or inactive position inside hand-held power tool housing 26*a* of hand-held power tool 12*a*, and an anti-rotation lock between guard unit 20*a* and hand-held power tool 12*a* is released. A position of guard unit 20*a* on receiving flange 104*a* may be changed only in the inactive position.

When an operator presses actuating element 68*a* into a switched-on position, the bolt is therefore moved along radial direction 100*a* in the direction of receiving flange 104*a*, and thereby engages in one of the recesses in guard unit 20*a*. At the same time, hand-held power tool 12*a* is in an active state, and motor unit 16*a* may be started. When guard unit 20*a* and/or the recesses are located in a position on receiving flange 104*a* that is rotated relative to the bolt, thereby preventing an anti-rotation lock of the bolt with one of the recesses, the bolt may be moved only partially along radial direction 100*a* when hand-held power tool 12*a* is switched on. The bolt is therefore in a position that deviates from an anti-rotation lock position, and motor unit 16*a* is prevented from being switched on using actuating element 68*a*. It is also basically feasible, however, for anti-rotation lock unit 14*a* to be provided with a detection means that is capable of detecting when a guard unit 20*a* is installed on hand-held power tool 12*a* and advantageously prevents hand-held power tool 12*a* from being operated when guard unit 20*a* is not present.

Furthermore, hand-held power tool system 64*a* includes a coding device 118*a*, which is provided to prevent tools 18*a* and/or tools 18*a* together with guard unit 20*a* from being installed on unsuitable hand-held power tools 12*a*. To this end, clamping band 74*a* includes a coding element 120*a* of coding unit 118*a*, which is designed as a single piece with clamping band 74*a*. Coding element 120*a* is designed as a pressed-out region that extends inwardly in radial direction 110*a* and has a rectangular shape. Correspondingly, receiving flange 104*a* includes a coding element 122*a* of coding device 118*a*, which is designed as a recess into which coding element 120*a* of clamping band 74*a* may be inserted when guard unit 20*a* is installed on hand-held power tool 12*a*. After guard unit 20*a* has been inserted onto hand-held power tool receiving unit 28*a*, guard unit 20*a* may be rotated into a working position. To this end, receiving flange 104*a* includes a groove 124*a* that extends in circumferential direction 62*a*, 106*a*, in which coding element 120*a* is guided when guard unit 20*a* is rotated into the working position. At the same time, guard unit 20*a* is captively located on hand-held power tool 12*a* via groove 124*a* and coding element 120*a*.

To make it easier for an operator to attach guard unit 20*a* and/or to change the position of installed guard unit 20*a* on receiving flange 104*a* of hand-held power tool 12*a*, hand-held power tool system 64*a* includes a positioning device 126*a*. Positioning device 126*a* includes several positioning elements 128*a* on receiving flange 104*a*, which are located one after the other in circumferential direction 62*a*, 106*a*, and each of which is designed as an indentation. Positioning elements 128*a* are located along axis 94*a* in a region of receiving flange 104*a* that faces away from tool 18*a*. Guard unit 20*a* also includes a positioning element 130*a* of positioning device 126*a*, which is designed as a single piece with clamping band 74*a*. Positioning element 130*a* is located along axis 94*a* in an edge region 132*a* of clamping band 74*a*. When guard unit 20*a* is installed on tool 18*a*, edge region 132*a* faces away from tool 18*a*. Positioning element 130*a* is designed as a segment in circumferential direction 62*a*, 106*a*. Positioning element 130*a* is punched out of clamping band 74*a* along two sides that face clamping band 74*a*, and it is located in an end region in circumferential direction 62*a*, 106*a* on clamping band 74*a*. On a free end 134*a* in circumferential direction 62*a*, 106*a*, positioning element 130*a* includes a pressed-out region that extends inwardly in radial direction 1 00*a* and has a contour that is essentially identical in shape to a contour of positioning elements 128*a* of receiving flange 104*a*.

Alternative exemplary embodiments are shown in FIGS. 3 through 6. Components, features, and functions that are essentially the same are labelled with the same reference numerals. To distinguish the exemplary embodiments from each other, the reference numerals of the exemplary embodiments are appended with the letters a through e. The description below is essentially limited to the differences from the exemplary embodiment in FIGS. 1 and 2. With regard for the components, features, and functions that remain the same, reference is made to the description of the exemplary embodiment in FIGS. 1 and 2.

Figure 3:
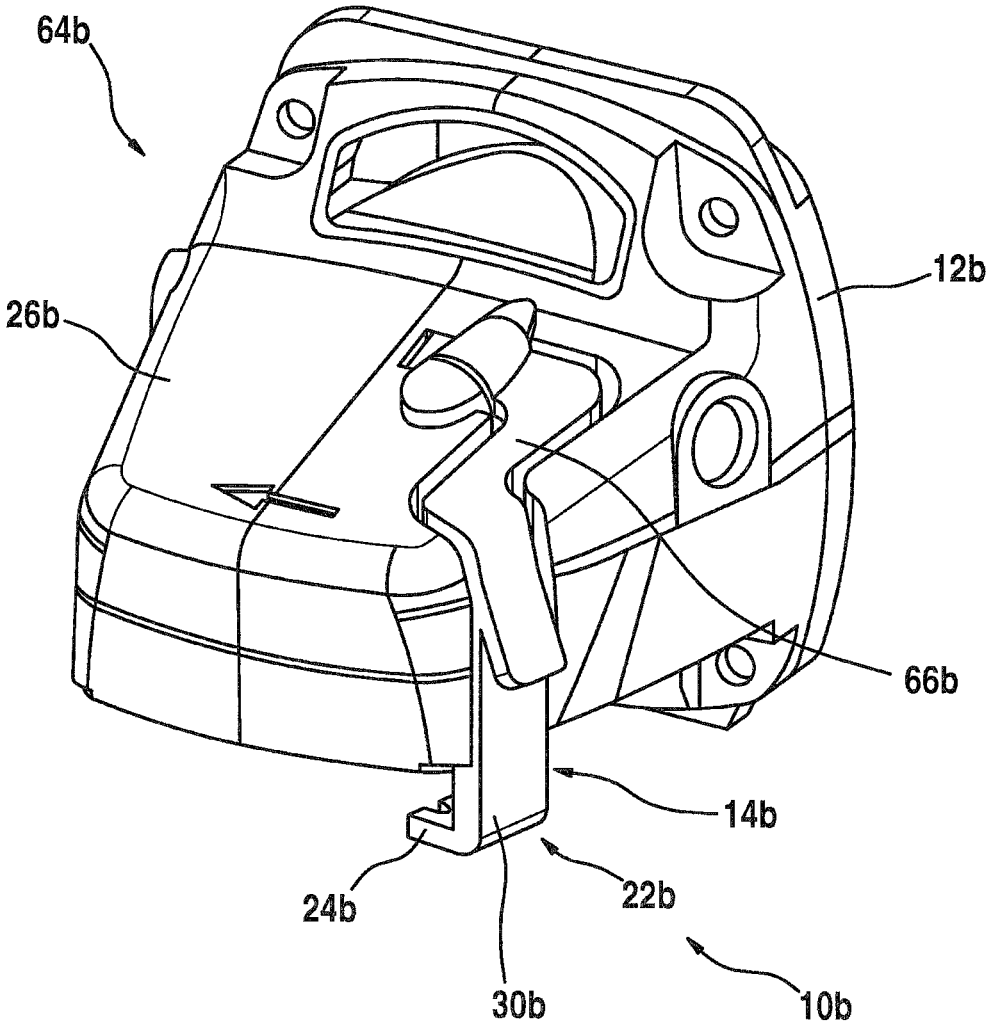
FIG. 3 shows a partial view of the hand-held power tool system with an alternative anti-rotation lock that is coupled with a spindle lock function of the hand-held power tool.

FIG. 3 shows a partial sectional view of a hand-held power tool system 64*b* that is an alternative to that shown in FIG. 2. Hand-held power tool system 64*b* includes a guard anti-rotation lock device 10*b* with an anti-rotation lock unit 14*b* that includes an anti-rotation lock element 24*b* designed as a form-fit element 30*b* and located on a hand-held power tool 12*b*. Form-fit element 30*b* is formed by a toothing, which, in an anti-rotation lock position, engages in a not-shown form-fit element of a guard unit that corresponds to the toothing. Form-fit element 30*b* of hand-held power tool 12*b* is designed as a single piece with an actuating element 66*b* of hand-held power tool 12*b*. Actuating element 66*b* is provided for adjusting a spindle lock function, so that an anti-rotation lock between the guard unit and hand-held power tool 12*b* is coupled to an operating parameter, which includes an active state of hand-held power tool 12*b* in which torque is transferred to a tool. When actuating element 66*b* is located in a spindle lock function, i.e., a rotation of a not-shown drive shaft of hand-held power tool 12*b* for driving the tool is blocked, form-fit elements 30*b* are disengaged, and an operator may remove or install the guard and/or the tool. When the spindle lock function has been released by actuating element 66*b*, an anti-rotation lock between the guard unit and hand-held power tool 12*b* is therefore realized simultaneously via the two form-fit elements 30*b*, and a blocking of the drive shaft is released.

Figure 4:
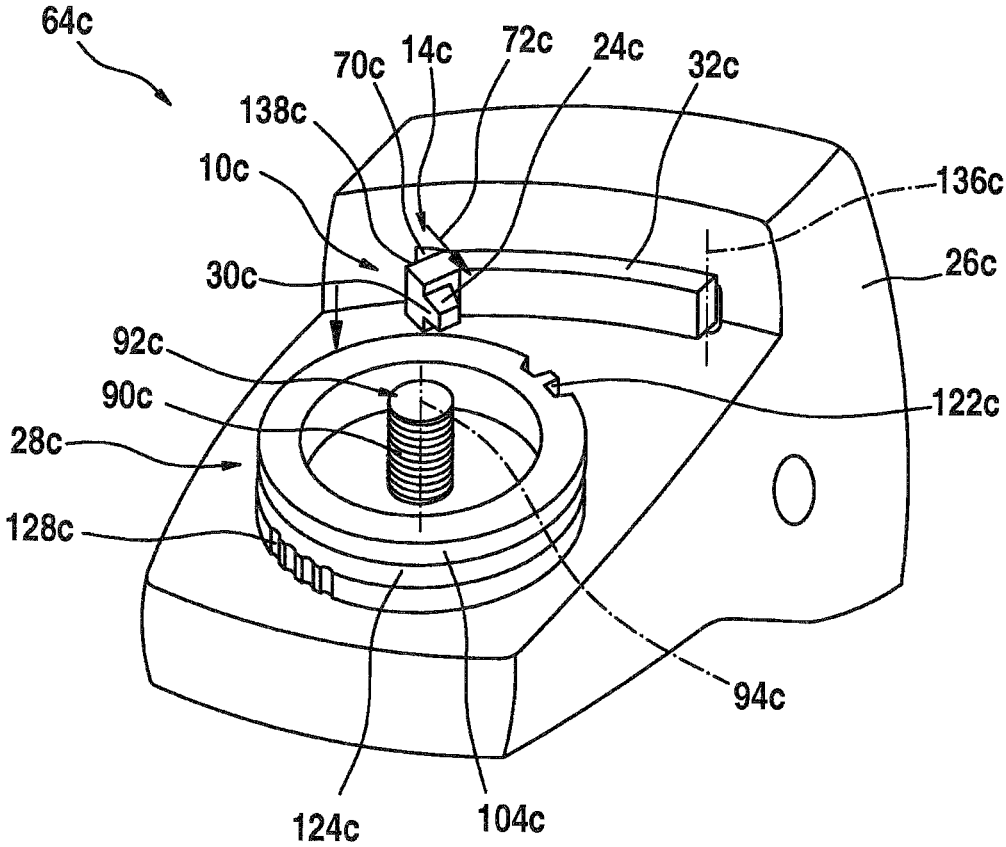
FIG. 4 shows a partial view of the hand-held power tool system with an alternative anti-rotation lock that is coupled with a fan of the hand-held power tool.

FIG. 4 shows a partial sectional view of a hand-held power tool system 64*c* that is an alternative to that shown in FIGS. 2 and 3. Hand-held power tool system 64*c* includes a guard anti-rotation lock device 10*c* with an anti-rotation lock unit 14*c*, which includes an anti-rotation lock element 24*c* designed as a form-fit element 30*c*, which is a detent cam. Anti-rotation lock element 24*c* is designed as a single piece with a lever element 32*c* of anti-rotation lock unit 14*c*. Lever element 32*c* is rotatably located on hand-held power tool 12*c*. Hand-held power tool 12*c* and/or anti-rotation lock unit 14*c* also include(s) a fan, which is provided to generate an air flow during operation of hand-held power tool 12*c*, and which is located inside a hand-held power tool housing 26*c*. To this end, ventilation openings 70*c* designed as air outlet openings are located on hand-held power tool housing 26*c*, through which the air flow exits during operation of hand-held power tool 12*c*. In flow direction 72*c*, lever element 32*c* is located downstream of ventilation openings 70*c* in hand-held power tool housing 26*c*. In an active state and/or during operation of hand-held power tool 12*c*, lever element 32*c* is pushed away from hand-held power tool housing 26*c* in the direction of a receiving flange 104*c* and/or a guard unit, and anti-rotation lock element 24*c* is moved into an anti-rotation lock position with the guard unit. To disengage form-fit element 30*c* located on lever element 32*c* from guard unit when hand-held power tool 12*c* is in a switched-off state, lever element 32*c* is rotatably supported using a not-shown spring element. Lever element 32*c* may be moved back into its home position using a spring force of the spring element. Form-fit element 30*c* is located on an end 138*c* of lever element 32*c* that faces away from a rotation axis 136*c* of lever element 32*c*.

Figure 5:
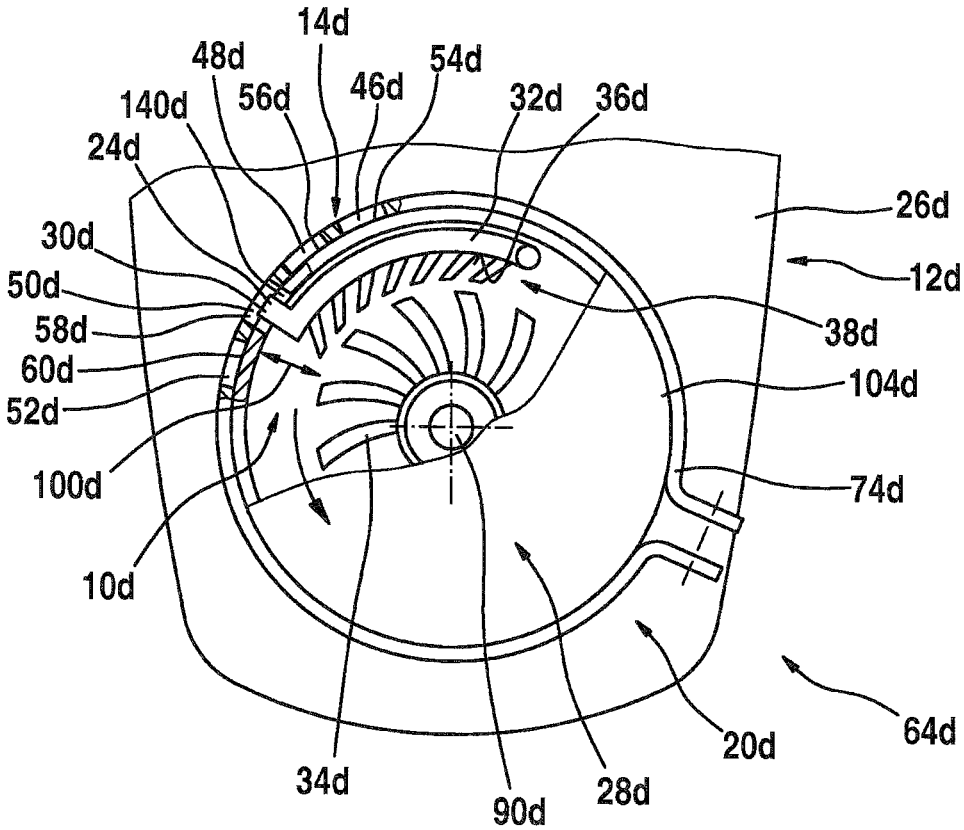
FIG. 5 shows a partial view of the hand-held power tool system with an alternative guard anti-rotation lock that includes an additional fan.

FIG. 5 shows a partial sectional view of a hand-held power tool system 64*d* that is an alternative to that shown in FIGS. 2 and 4. Hand-held power tool system 64*d* includes a guard anti-rotation lock device 10*d* with an anti-rotation lock unit 14*d*, which includes an anti-rotation lock element 24*d* designed as a form-fit element 30*d*, which is a detent cam. Anti-rotation lock element 24*d* is designed as a single piece with a lever element 32*d* of anti-rotation lock unit 14*d*. Lever element 32*d* is rotatably located on hand-held power tool receiving unit 28*d* of hand-held power tool 12*d*. In addition, a fan 34*d* is located inside hand-held power tool receiving unit 28*d*. An operation of fan 34*d* is coupled to an operation of a tool and/or a transfer of a drive torque to a drive shaft 90*d*. Lever element 32*d* is supported via a not-shown spring element such that it is movable outwardly along a radial direction 100*d* between fan 34*d* and a receiving flange 104*d* of hand-held power tool receiving unit 28*d*. Receiving flange 104*d* includes a recess 140*d* through which the detent cam extends during operation of hand-held power tool 12*d* and, with form-fit elements 54*d*, 56*d*, 58*d*, 60*d* of guard unit 20*d* designed as recesses, prevents guard from rotating. Lever element 32*d* also includes a chamber-type recess 38*d* on a side 36*d* facing fan 34*d*, through which an effect of the force of the air flow is increased in order to move anti-rotation lock element 24*d* into an anti-rotation lock position. Anti-rotation lock element 24*d* is moved back out of the anti-rotation lock position after operation of hand-held power tool 12*d* in a manner analogous to that described with reference to FIG. 4.

Figure 6:
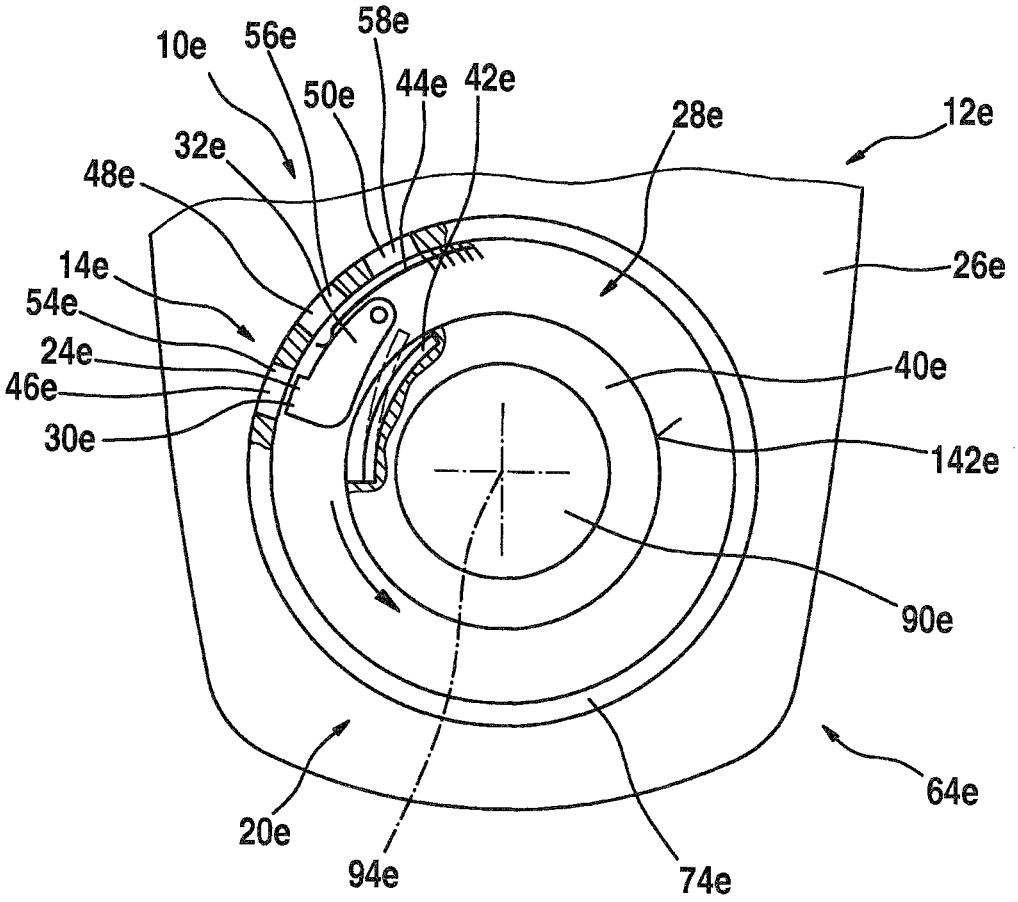
FIG. 6 shows a partial view of the hand-held power tool system with an alternative guard anti-rotation lock that includes an additional shaft.

FIG. 6 shows a partial sectional view of a hand-held power tool system 64*e* that is an alternative to that shown in FIGS. 2 and 5. Hand-held power tool system 64*e* includes a guard anti-rotation lock device 10*e* with an anti-rotation lock unit 14*e*, which includes an anti-rotation lock element 24*e* designed as a form-fit element 30*e*, which is a detent cam, and which is located inside hand-held power tool receiving unit 28*e* of a hand-held power tool, in a manner analogous to that described with reference to FIG. 5. To move the detent cam into an anti-rotation lock position, anti-rotation lock unit 14*e* includes a shaft 40*e* designed as a hollow shaft, which is non-rotatably coupled with a drive shaft 90*e*. An eccentric element 42*e* designed as a leaf spring is located on shaft 40*e* on a radially outwardly directed side 142*e*. During operation of hand-held power tool 12*e*, eccentric element 42*e* is pressed outwardly against lever element 32*e* by the centrifugal forces acting on the leaf spring when drive shaft 90*e* rotates around an axis 94*e* (shown in FIG. 6 as a dashed line). This creates a radially outwardly acting force on lever element 32*e*, so that the detent cam located on lever element 32*e* engages in an anti-rotation lock element 46*e*, 48*e*, 50*e* of a guard unit 20*e* provided to prevent rotation and designed as a recess. Anti-rotation lock unit 14*e* also includes a restoring element 44*e* that is designed as a spring element, and that moves anti-rotation lock element 24*e* and/or lever element 32*e* out of an anti-rotation lock position and into a starting position as soon as a transfer of drive torque via drive shaft 90*e* to the tool has been halted, and/or as soon as operation of hand-held power tool 12*e* has been halted.

What is claimed is:

1. An assembly, comprising a hand-held power tool having a tool housing;

a receiving unit for receiving a tool;

a guard unit arranged to enclose a region of the tool;

a guard anti-rotation lock unit connecting said guard unit to said hand-held power tool and disconnecting said guard unit from said hand-held power tool; and a switching mechanism for turning on the hand-held power tool and for turning off the hand-held power tool;

wherein the guard anti-rotation lock unit comprises a form-fit unit which, in response to operating the switching mechanism for turning on said hand-held power tool, establishes a form-fit connection of said guard unit with said hand-held power tool to prevent a rotation of said guard unit relative to said hand-held power tool and in response to operating the switching mechanism for turning off said hand-held power tool, the form-fit unit disestablishing the form-fit connection to allow the rotation of said guard unit relative to said hand-held power tool.

2. An assembly as defined in claim 1, where said form-fit unit includes a form-fit lock element positioned on said tool housing and movable between a position in which the form-fit lock element provides a form-fit connection of said guard unit with said tool housing and a position in which it disconnects said guard unit from said tool housing and where the switching mechanism controls form-fit lock element positioning.

3. An assembly as defined in claim 1, wherein said form-fit unit includes a plurality of anti-rotation lock elements provided on said guard unit, and a form-fit lock element provided on said tool housing of said hand-held power tool and which form-fit lock element is movable relative to the guard unit so that in response to turning on said hand-held power tool using the switching mechanism, said form-fit lock element engages with one of said anti-rotation lock elements to mechanism a form-fit connection to prevent said guard unit rotation, and in response to turning off said hand-held power tool using the switching mechanism, said form-fit lock element disengages from said one of said anti-rotation lock elements provided on said guard unit to disestablish the form fit connection to allow said guard unit rotation.

4. An assembly as defined in claim 3, wherein said form-fit lock element comprises a lever element, which is rotatably supported on said tool housing.

5. An assembly as defined in claim 3, further comprising an eccentric element, which in response to turning on the hand-held power tool is pressed under the action of centrifugal forces engage said form-fit lock element with one of said anti-rotation lock elements of said guard unit.

6. An assembly as defined in claim 5, wherein said eccentric element is formed as a spring element which, in response to turning off of the hand-held power tool stops acting on said form-fit lock element.

7. An assembly as defined in claim 3, wherein the switching mechanism cannot turn on the hand-held power tool from an off state to an on state if the form-fit unit lock element is not moveable from its inactive or recessed position to an active or recess-engaging position.

8. An assembly, comprising a hand-held power tool having a tool housing;

a receiving unit for receiving a tool;

a guard unit arranged to enclose a region of the tool;

a guard anti-rotation lock unit connecting said guard unit to said hand-held power tool and disconnecting said guard unit from said hand-held power tool; and a switching mechanism for turning on the hand-held power tool and for turning off the hand-held power tool;

wherein the guard anti-rotation lock unit includes means for controlling guard unit rotation that is responsive to the switching mechanism and that operates to prevent a rotation of the guard unit relative to said hand-held power tool in response to turning on said hand-held power tool using the switching mechanism and that operates to allow rotation of said guard unit relative to said hand-held power tool in response to turning off said hand-held power tool using the switching mechanism.

9. An assembly as defined in claim 8, wherein said means for controlling guard unit rotation comprises a form-fit unit which, in response to turning on said hand-held power tool using the switching mechanism, operates to establish a form-fit connection of said guard unit with said hand-held power tool.

10. An assembly as defined in claim 9, wherein said form-fit unit includes a form-fit lock element that is positioned on said tool housing and is movable between a position in which the form-fit lock element provides a form-fit connection of said guard unit with said tool housing and a position in which the form-fit lock element disconnects said form-fit connection of said guard unit with said tool housing, automatically in response to turning on and to turning off the hand-held power tool, respectively, using the switching mechanism.

11. An assembly as defined in claim 10, wherein the switching mechanism cannot turn on the hand-held power tool from an off state to an on state if the form-fit unit lock element is not moveable from its inactive or recessed position to an active or recess-engaging position.

* * * * *